US008152256B2

(12) United States Patent
Kim

(10) Patent No.: US 8,152,256 B2
(45) Date of Patent: Apr. 10, 2012

(54) ACCEPTING DEVICE FOR REFRIGERATOR

(75) Inventor: Do-Hyung Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 12/440,417

(22) PCT Filed: Sep. 6, 2007

(86) PCT No.: PCT/KR2007/004298

§ 371 (c)(1),
(2), (4) Date: Jun. 17, 2009

(87) PCT Pub. No.: WO2008/030043

PCT Pub. Date: Mar. 13, 2008

(65) Prior Publication Data

US 2010/0192621 A1 Aug. 5, 2010

(30) Foreign Application Priority Data

Sep. 7, 2006 (KR) ..... 10-2006-0086380

(51) Int. Cl.

| | |
|---|---|
| ***A47B 96/04*** | (2006.01) |
| *A47B 88/00* | (2006.01) |
| *B65D 1/24* | (2006.01) |
| *B65D 85/00* | (2006.01) |
| *B65D 43/20* | (2006.01) |

(52) U.S. Cl. ..... 312/404; 312/301; 312/348.3; 220/526; 220/523; 220/345.5

(58) Field of Classification Search ..... 312/404, 312/348.3, 291, 301, 402, 401, 293.1, 293.2, 312/293.3, 295, 298, 299, 300, 302, 303; 220/253, 526, 507, 345.5, 345.4, 345.1
See application file for complete search history.

(56) References Cited

U.S. PATENT DOCUMENTS

| | | | | |
|---|---|---|---|---|
| 81,802 | A * | 9/1868 | Lyman | 220/345.5 |
| 464,409 | A * | 12/1891 | Williams | 312/295 |
| 800,040 | A * | 9/1905 | Wilmot | 312/270.1 |
| 1,134,540 | A * | 4/1915 | Kress | 217/62 |
| 1,219,412 | A * | 3/1917 | Bertram | 312/279 |
| 1,239,307 | A * | 9/1917 | Schmid | 232/43.1 |
| 1,696,456 | A * | 12/1928 | Sebring | 220/215 |
| 2,118,099 | A * | 5/1938 | Mirk | 220/345.5 |
| 2,202,684 | A * | 5/1940 | Baker | 312/295 |
| 2,276,635 | A * | 3/1942 | Weber | 220/349 |
| 2,898,173 | A * | 8/1959 | Squire | 312/248 |
| 4,757,913 | A * | 7/1988 | Yerman | 220/345.5 |
| 5,016,772 | A * | 5/1991 | Wilk | 220/8 |
| 7,712,852 | B2 * | 5/2010 | Choi et al. | 312/402 |
| 7,896,451 | B2 * | 3/2011 | Walsh | 312/228.1 |

(Continued)

FOREIGN PATENT DOCUMENTS

KR 20-1990-0006299 Y1 7/1990

(Continued)

*Primary Examiner* — David Dunn
*Assistant Examiner* — Ryan A Doyle
(74) *Attorney, Agent, or Firm* — Birch, Stewart, Kolasch & Birch, LLP

(57) ABSTRACT

A storage device for a refrigerator includes a storage box defining a storage chamber storing food therein and installed removably in a storage space, an opening/closing unit for opening/closing partly or fully the storage chamber, and a guide unit for guiding the opening/closing of the storage chamber by the opening/closing unit. An apparatus/method is provided.

2 Claims, 4 Drawing Sheets

U.S. PATENT DOCUMENTS

| | | | | |
|---|---|---|---|---|
| 2002/0163284 | A1* | 11/2002 | Levy et al. | 312/302 |
| 2004/0178708 | A1* | 9/2004 | O'Halloran et al. | 312/404 |
| 2007/0018548 | A1* | 1/2007 | Ertz et al. | 312/402 |
| 2009/0121599 | A1* | 5/2009 | Laible | 312/404 |
| 2011/0001415 | A1* | 1/2011 | Park et al. | 312/408 |

FOREIGN PATENT DOCUMENTS

| | | | |
|---|---|---|---|
| KR | 20-0112069 | Y1 | 4/1998 |
| KR | 20-1999-0028591 | U | 7/1999 |

* cited by examiner

[FIG. 1]
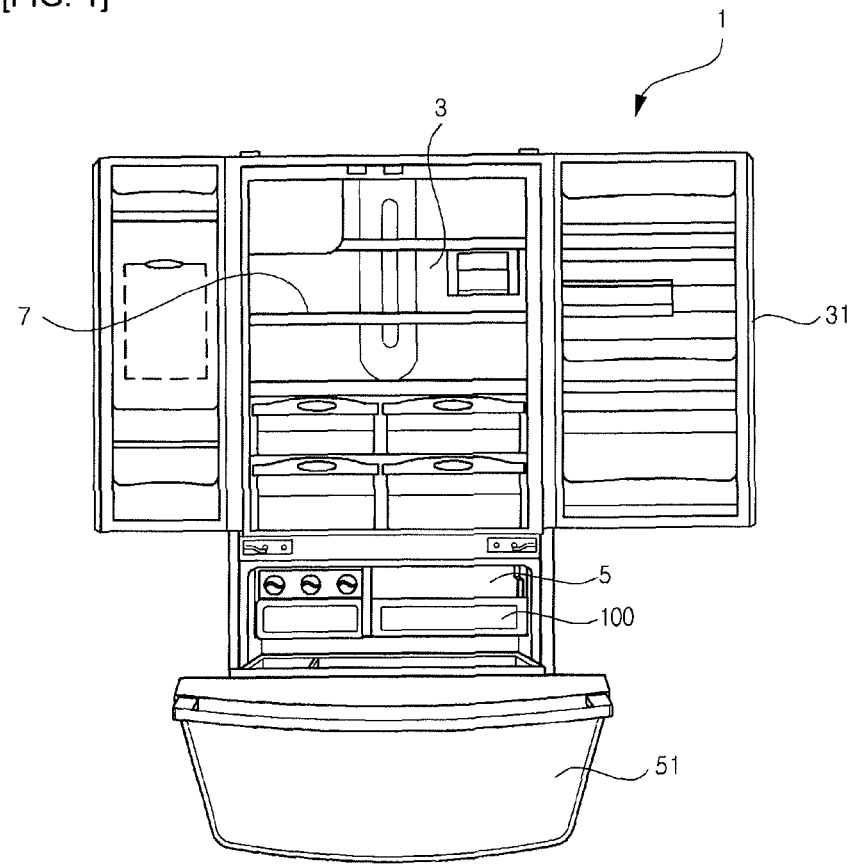
[FIG. 2]
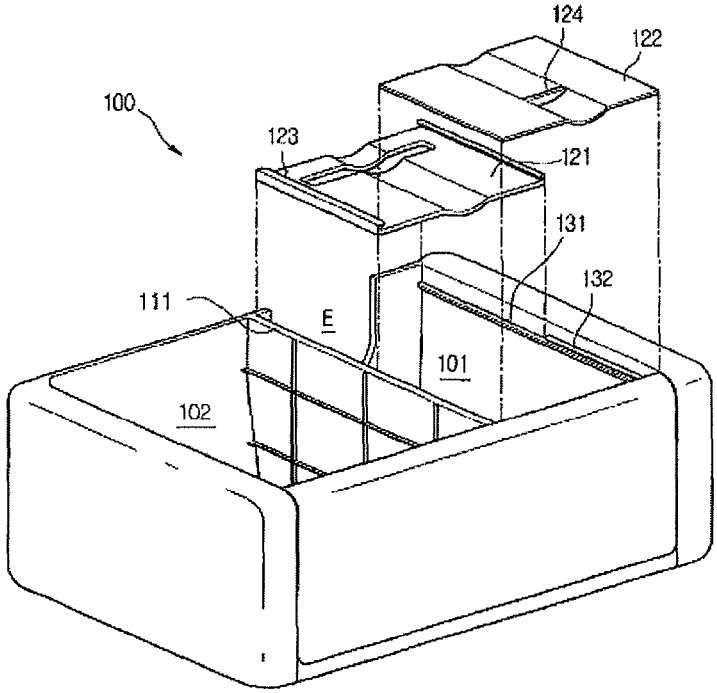

[Fig. 3]
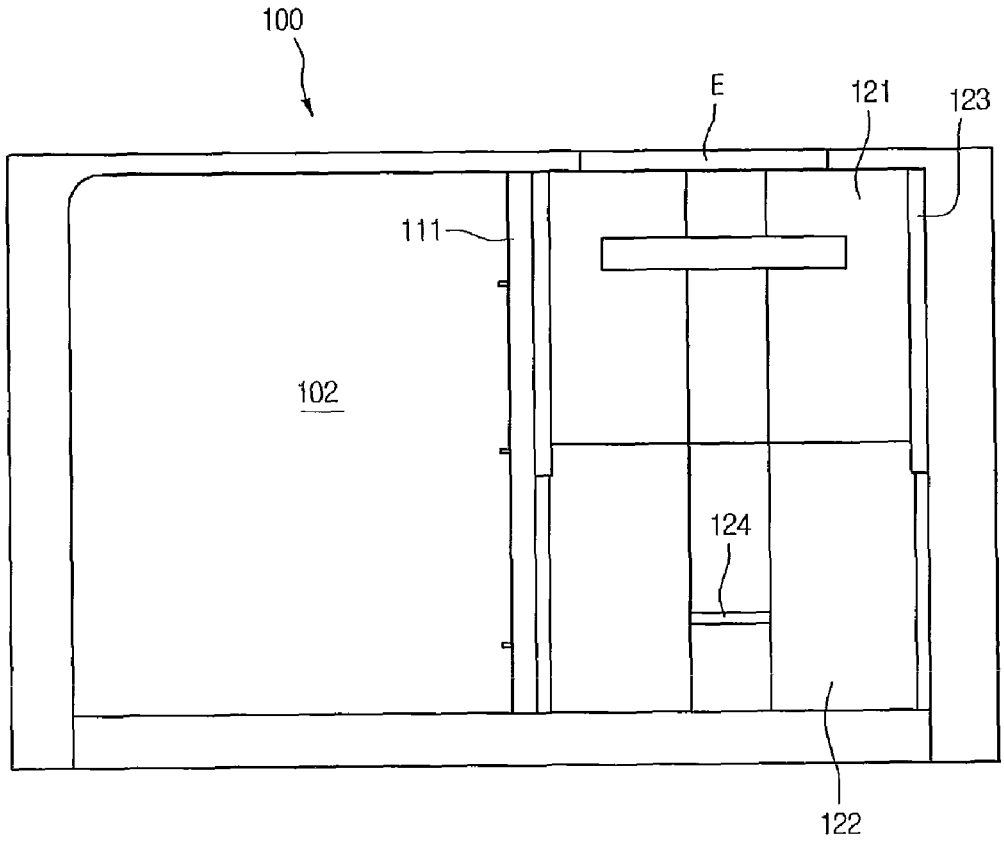
[Fig. 4]
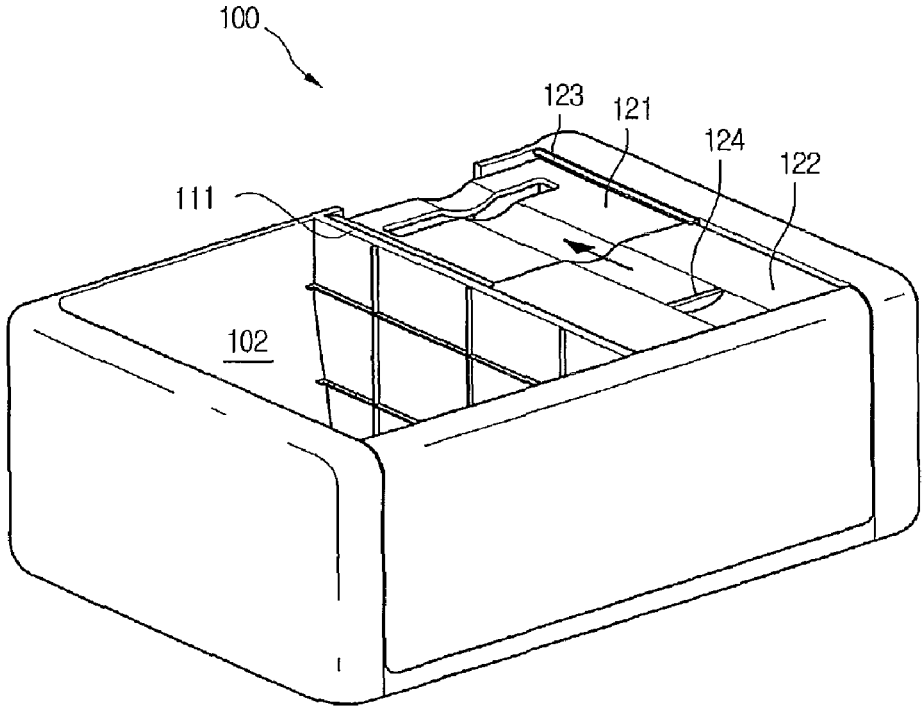

[Fig. 5]
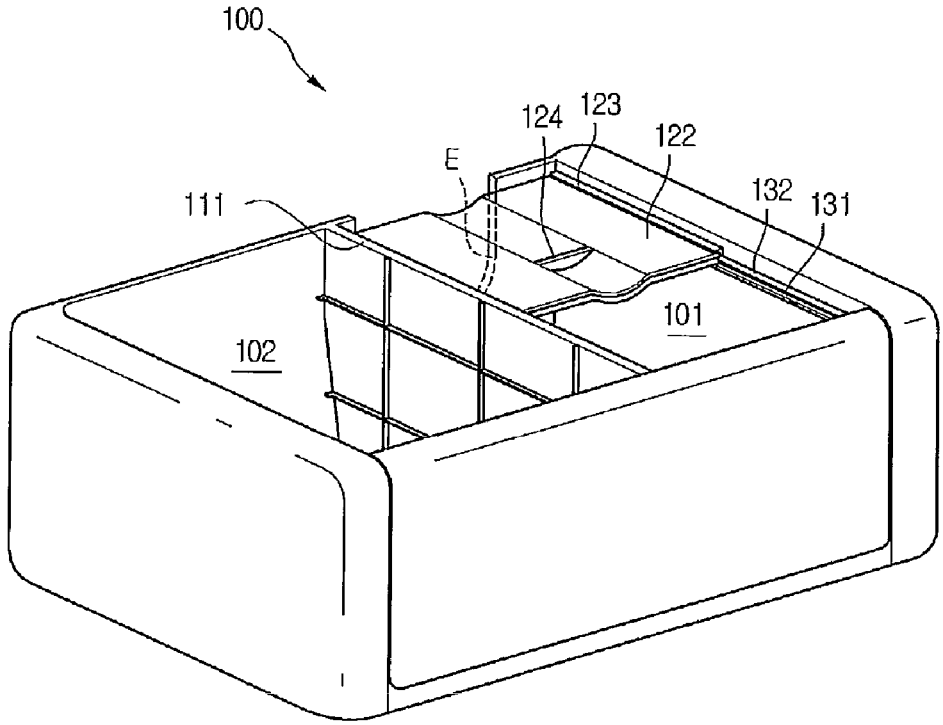
[Fig. 6]
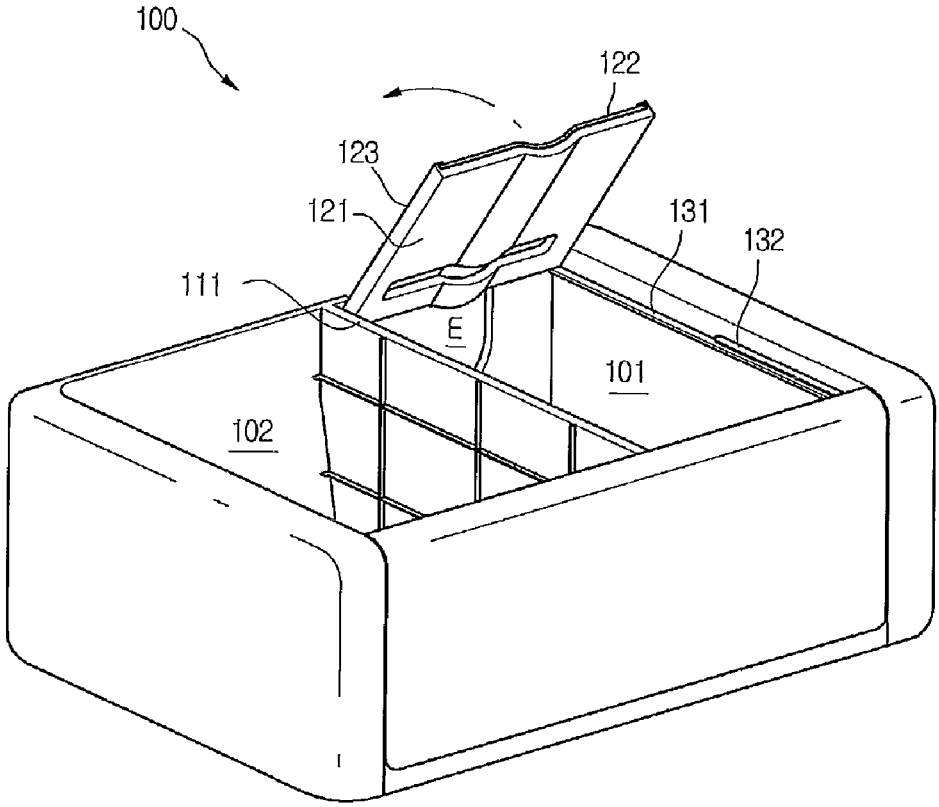

[Fig. 7]
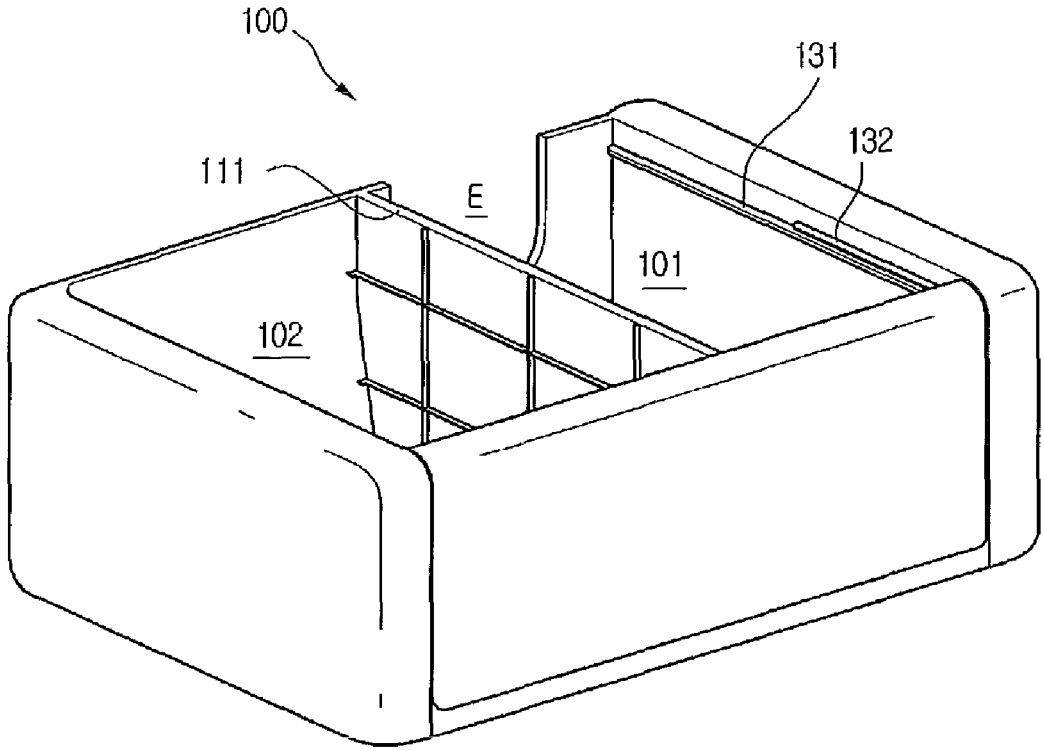
[Fig. 8]
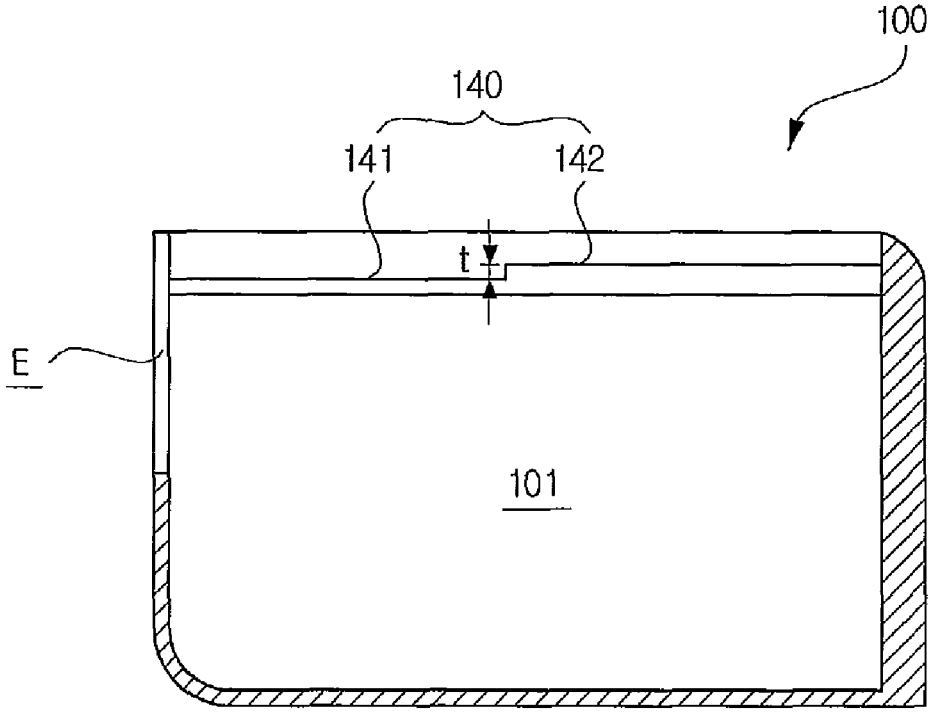

ACCEPTING DEVICE FOR REFRIGERATOR

TECHNICAL FIELD

The present disclosure relates to a refrigerator.

BACKGROUND ART

Generally, a refrigerator is a home appliance maintained at a low temperature in order to keep food fresh for a long time.

The refrigerator has a refrigerating compartment that is maintained at a temperature 1-4° C. in order to keep food such as vegetables and fruits fresh and a freezing compartment that is maintained at a temperature of −18° C. or less in order to keep food such as meats and fishes frozen.

The refrigerators may be classified into a top mount type where the freezing compartment is located above the refrigerating compartment, a bottom freezer type where the freezing compartment is located below the refrigerating compartment, and a side-by-side type where the refrigerating and freezing compartments are located left and right.

The refrigerator is maintained at the refrigerating and freezing temperatures as air and a refrigerant are heat-exchanged with each other in the respective refrigerating and freezing compartments.

A plurality of shelves for supporting or laying food thereon are arranged along a vertical direction in the refrigerating and freezing compartments and/or receiving boxes are disposed in the refrigerating and freezing compartments to be capable of sliding in and out.

DISCLOSURE OF INVENTION

Technical Problem

Embodiments provide a storage device for a refrigerator, which can improve space efficiency by dividing a storage chamber into at least two sections.

Embodiments also provide a storage device for a refrigerator, which can more freshly store food received in a storage chamber.

Technical Solution

In one embodiment, a storage device for a refrigerator includes a storage box defining a storage chamber storing food therein and installed removably in a storage space, an opening/closing unit for opening/closing partly or fully the storage chamber, and a guide unit for guiding the opening/closing of the storage chamber by the opening/closing unit.

In another embodiment, a storage device for a refrigerator includes a storage box having an opened top, a plurality of opening/closing units for selectively opening/closing at least a portion of the opened top of the storage box, and a guide unit supporting both side ends of the opening/closing units, wherein at least one of the opening/closing units is capable of sliding along the guide unit.

Advantageous Effects

According to the storage device of the present disclosure, the storage chamber is divided into left and right sections by at least one dividing plate. Therefore, different kinds of food can be stored in different chambers, thereby enhancing the space efficiency.

In addition, the storage chamber is at least partly opened by first and second covers or has a top that can be fully opened.

Therefore, the food can go in and out of the storage chamber efficiently. Further, smell does not seep into other foods stored in the different storage chambers and moisture of the food is not vaporized. As a result, the food can be more freshly preserved.

BRIEF DESCRIPTION OF THE DRAWINGS

FIG. 1 is a front view illustrating an internal structure of a refrigerator having a storage device according to an embodiment of the present disclosure.

FIG. 2 is an exploded perspective view of a storage device of FIG. 1.

FIG. 3 is a top plane view of the storage device of FIG. 2.

FIGS. 4 through 7 are views illustrating a process for opening and closing a storage chamber by the storage device of FIG. 1.

FIG. 8 is a side sectional view of a storage device for a refrigerator according to another embodiment.

MODE FOR THE INVENTION

FIG. 1 is a front view illustrating an internal structure of a refrigerator having a storage device according to an embodiment of the present disclosure.

Referring to FIG. 1, a refrigerator of an embodiment includes a main body 1 having refrigerating and freezing compartments 3 and 5, refrigerating and freezing doors 31 and 51 for selectively opening/closing the refrigerating and freezing compartments 3 and 5, respectively, and a plurality of shelves 7 provided in the refrigerating and freezing compartments 3 and 5 for supporting food.

A plurality of storing boxes 100 for storing the food are provided in the re-frigerating and freezing compartments 3 and 5. The storing boxes 100 are provided in the form of drawers to be capable of sliding in and out of the storage chamber. Each of the storing boxes 100 is formed in a hexahedron shape having an opened top to define a food storage chamber. The food stored in the storage chamber is refrigerated or frozen by cool air supplied to the refrigerating and freezing compartments 3 and 5.

FIG. 2 is an exploded perspective view of a storage device of FIG. 1 and FIG. 3 is a top plane view of the storage device of FIG. 2.

Referring to FIGS. 2 and 3, the storage chamber defined by each of the storing boxes 100 is divided into separated chambers by a dividing plate 111. Right and left chambers divided by the diving plate 111 in the drawings will be referred to as first and second storage chambers 101 and 102, respectively.

First guide ribs 131 are formed on upper portions of both inner-side surfaces of the first storage chamber 101. The first guide ribs 131 extend in a front-to-rear direction and have a length equal to or less than a front-to-rear width of the first storage chamber 101. Second guide ribs 132 are formed above the first guide ribs 131 on the both inner-side surfaces of the first storage chamber 101. A rear end of the second guide rib 132 is spaced apart from a rear end of the first storage chamber 131 by a predetermined distance. That is, a length of the second guide rib 132 is less than that of the first guide rib 131.

A distance from the rear surface of the storing box 100 to the rear end of the second guide rib 132 is identical to or greater than a front-to-rear width of a first cover 121.

The first cover 121 is provided to selectively open and close a rear half of the first storage chamber 101. The first cover 121 is formed in a rectangular plate having a pre-determined length. The first cover 121 opens the rear half of the first storage chamber 101 by being lifted in a state where the both side edges of the first cover 121 seats on the rear ends of the top surfaces of the first guide ribs 131.

In addition, fixing slots 123 are formed on the both side edges of the first cover 121. Inner-bottom surfaces of the fixing slots 123 are located at an identical horizontal plan to top surfaces of the second guide ribs 132. A height of each of the fixing slots 123 may be set to correspond to a thickness of a second cover 122. In more detail, as the inner-bottom surfaces of the fixing slots 123 are located on the identical horizontal plane to the top surfaces of the second guide ribs 132, the second cover 122 can be smoothly inserted into the fixing slots 123.

Meanwhile, in order to selectively open and close a front half of the first storage chamber 101, a second cover 122 is provided. The second cover 122 closes the front half of the first storage chamber 101 in a state where both side edges of the bottom surface of the second cover 122 seat on the top of the second guide rig 132. In this state, as the second cover 122 moves rearward along the second guide rib 132, the front half of the first storage chamber 101 is opened. As described above, in the course of opening the front half of the first storage chamber 101, the second cover 122 seats on the top of the first cover 121 and the both side edges of the second cover 122 are inserted in the fixing slots 123.

A handle 124 is formed on a portion of the top surface of the second cover 122. The handle 124 makes it easy for a user to move the second cover 122 frontward or rearward of the first storage chamber 101.

Meanwhile, a cool air opening E is formed on a portion of the rear end of the first storage chamber 101. The cool air opening E is formed to directly supply the cool air circulating to the refrigerating compartment. Therefore, the first storage chamber 101 is maintained at a relatively lower temperature by the cool air supplied through the cool air opening E as compared with the second storage chamber 102.

The following will describe a process for opening/closing the storage chamber by the above described storage chamber.

FIGS. 4 through 7 are views illustrating a process for opening and closing the storage chamber by the storage device of FIG. 1.

Food is stored in the first storage chamber 101. In this state, in order to prevent smell from seeping into other foods stored in the different storage chambers and prevent moisture of the food from being vaporized, the first storage chamber 101 must be closed.

Referring to FIG. 4, the first storage chamber is closed by the first and second covers 121 and 122. In this state, in order to take the food stored in the first storage chamber out of the first storage chamber 101, the first storage chamber 101 is opened. At this point, when the size of the food is relatively small, as shown in FIG. 5, the second cover 122 moves rearward along the second guide rib 132 to open the front half of the first storage chamber 101. At this point, the second cover 122 seats snugly on the top surface of the first cover 121. The user takes the food out of the first storage chamber 101 through the opened front half.

When the size of the food is relatively large, i.e., when the size of the food is larger than the front half of the first storage chamber 101, the front and rear halves of the first storage chamber 101 are opened.

As shown in FIGS. 6 and 7, the first cover 121 is removed by being lifted in a state where the second cover 122 seats on the top surface of the first cover 121 along the guide slots 123. Then, the first storage chamber 101 is fully opened so that the user can take the food out of the first storage chamber 101 through the opened front and rear halves.

FIG. 8 is a side sectional view of a storage device for a refrigerator according to another embodiment.

In this embodiment, each of guide ribs 140 includes a seating portion 141 and a guide portion 142. The seating portion is stepped downward by a predetermined length from a rear end of the guide rib 140. The guide portion 142 is formed in front of the seating portion 141. A length of the seating portion 141 corresponds to a front-to-rear length of the first cover 121.

A depth of the stepped portion is identical to a thickness of the first cover 121. Other components and structures of this embodiment are same as those of the foregoing embodiment.

In the embodiments, the storage device is provided in the freezing compartment. However, the present disclosure is not limited to these embodiments. For example, the storage device may be provided in the refrigerating compartment.

In the embodiments, the guide ribs 131, 132, 140 are formed on the dividing plate that divides the storage chamber into separated two chambers. However, the present disclosure is not limited to this. That is, no dividing plate is provided and the guide ribs 131, 132, and 140 are provided on the both side surfaces of the storage box 100 to close the storage box 100.

Although embodiments have been described with reference to a number of illustrative embodiments thereof, it should be understood that numerous other modifications and embodiments can be devised by those skilled in the art that will fall within the spirit and scope of the principles of this disclosure.

The invention claimed is:

1. A storage device for a refrigerator, comprising:

a storage box defining a storage chamber storing food therein, the storage box having a side wall, a rear wall, a front wall and a bottom surface and divided into separated chambers by at least one dividing plate and installed removably in a storage space and a cool air opening formed in the rear wall;

an opening/closing unit for opening/closing at least one of the separated chambers; and a guide unit provided on the side wall for guiding the opening/closing of the separated chamber by the opening/closing unit, wherein the opening/closing units comprise:

a first cover provided at both side ends with slots which are formed by bending both side ends; and a second cover that is inserted in the slots to be capable of sliding on a top surface of the first cover and having a handle making the second cover move easily, wherein the guide unit comprises:

a first guide rib supporting the first cover; and a second guide rib formed above the first guide rib and supporting the second cover, wherein a top surface of the second guide rib and a top surface of the first cover are on an identical horizontal level in a state where the first cover seats on the first guide rib, wherein a rear end portion of the first guide rib further extends than a rear end portion of the second guide rib, and the first cover is provided between a rear end of the first guide rib and a rear end of the second guide rib, wherein a distance from a rear end of the second guide rib to an inner-rear surface of the storage box is identical to or greater than a front-to-rear width of the first cover, and wherein at least one of the first and second covers is removable from the storage box.

2. A storage device for a refrigerator, comprising:

a storage box having an opened top, bottom surface, side wall, rear wall and front wall, and a cool air opening formed in the rear wall;

a plurality of opening/closing units for selectively opening/closing at least a portion of the opened top of the storage box; and a guide unit supporting both side ends of the opening/closing units, wherein the opening/closing units comprise:

a first cover provided at both side ends with slots which are formed by bending both side ends; and a second cover that is inserted in the slots to be capable of sliding on a top surface of the first cover and having a handle making the second cover move easily, wherein the guide unit includes:

a guide rib that is stepped at least one time;

the first cover seats on the stepped portion of the guide rib; and the second cover seats on the top surface of the guide rib, wherein the guide rib is stepped by a depth corresponding to a thickness of the first cover, and wherein at least one of the first and second covers is removable from the storage box.

* * * * *